US005537761A

United States Patent [19]

Oh

[11] Patent Number: 5,537,761

[45] Date of Patent: Jul. 23, 1996

[54] WASHING MACHINE AND METHOD FOR CONTROLLING THE DRYING PROCESS THEREOF

[75] Inventor: Seung-Sub Oh, Incheon, Rep. of Korea

[73] Assignee: Daewoo Electronics Co., Ltd., Seoul, Rep. of Korea

[21] Appl. No.: 340,949

[22] Filed: Nov. 17, 1994

[30] Foreign Application Priority Data

Feb. 7, 1994 [KR] Rep. of Korea ..... 94-2229

[51] Int. Cl.[6] ..... B43L 7/10; D06F 29/00

[52] U.S. Cl. ..... 34/499; 34/596; 68/20

[58] Field of Search ..... 34/498, 499, 596, 34/482, 483, 484, 485, 486, 319; 68/20

[56] References Cited

U.S. PATENT DOCUMENTS

| | | | |
|---|---|---|---|
| 2,818,719 | 1/1958 | Cline . | |
| 3,091,955 | 6/1963 | Taylor et al. . | |
| 4,531,305 | 7/1985 | Nagayasu et al. | 34/486 X |
| 5,029,458 | 7/1991 | Obata et al. | 68/20 X |
| 5,058,401 | 10/1991 | Nakamura et al. | 68/19.2 |
| 5,111,673 | 5/1992 | Kadoya et al. | 68/20 X |
| 5,226,291 | 7/1993 | Goodwin | 34/493 |
| 5,291,667 | 3/1994 | Juslin et al. | 34/535 X |
| 5,388,348 | 2/1995 | Tanaica et al. | 34/493 X |

*Primary Examiner*—Hoang Nguyen
*Attorney, Agent, or Firm*—Anderson Kill Olick & Oshinsky

[57] ABSTRACT

A method for controlling the drying process of a vortex-type washing machine capable of accommodating a laundry article for drying therein comprises the steps of (A) heating an ambient air by a heater, (B) driving a motor in a forward direction, (C) driving the motor in a reverse direction to the forward direction, and (D) repeating the steps (B) to (C) until the laundry article become dried to a desired dry level, wherein each of the steps (B) and (C) includes the steps of (a) turning on the motor to rotate the pulsator to spread the laundry article; (b) turning off the motor to pause the rotation of the pulsator to thereby help the settlement of the laundry article; and (c) repeating the steps (a) to (b) at least N number of times.

8 Claims, 5 Drawing Sheets

WASHING MACHINE AND METHOD FOR CONTROLLING THE DRYING PROCESS THEREOF

FIELD OF THE INVENTION

The present invention relates to a washing machine capable of washing, dewatering and drying a laundry article; and, more particularly, to a method for controlling a laundry dryer incorporated in the washing machine.

DESCRIPTION OF THE PRIOR ART

Generally, there are two categories of washing machines which are in practical use for the purpose of washing laundry articles such as clothes. A first category involves a vortex-type washer wherein the laundry articles are subjected to a washing action as a pulsator therein rotates to generate a vortex flow within a washer tub. Such a vortex-type washer may encompass, in a broad sense, a stirrer-type washer wherein the laundry items are made to undergo vigorous frictional movement in the washing fluid by means of a bladed stirrer. Normally, the conventional vortex-type washer is not equipped with a drying mechanism therein.

A second category involves a drum-type washer having a horizontal rotary drum partially submerged in a laundering water. With this type of washer, the laundry articles contained in the rotary drum are rubbed against each other as the drum rotates about its horizontal axis. U.S. Pat. No. 5,058,401 issued to Fumio Nakamura et al. illustrates one of the second-type washers that can wash, dehydrate and dry the laundry. During the drying process of the laundry articles dewatered at a preceding dewatering process, an inner tub containing the dewatered laundry articles is rotated about a horizontal axis, heated air is supplied to the inner tub, and the laundry subjects are uniformly exposed to the hot air to dry.

Conventionally, the heated air should be concentrated on a point of the dewatered laundry articles for at least 60 seconds in order to ensure them to dry. However, in the second-type washer, the hot air is distributed to the entire area of the inner tub due to its continuous revolution during the drying process, to thereby result in an extended drying time period and loss of power.

SUMMARY OF THE INVENTION

It is, therefore, an object of the invention to provide a vortex-type washing machine having a laundry dryer therein.

It is another object of the invention to provide a method for controlling the laundry dryer in the vortex-type washing machine during a drying process.

In accordance with the present invention, there is provided an improved method for controlling a drying process of a vortex-type washing machine which has a tub capable of accommodating a laundry article for drying therein, a heating means, a pulsator rotatably mounted on the bottom surface of the tub, a motor for rotating the pulsator, wherein the method comprises the steps of: (A) providing heated air to the tub by using the heating means; (B) driving the motor in a forward direction; (C) driving the motor in a backward direction; and (D) repeating the steps (B) and (C) until the laundry article becomes dried to a desired level. Further, each of the steps (B) and (C) includes the steps of: (a) turning on the motor to rotate the pulsator to spread the laundry article; (b) turning off the motor to pause the rotation of the pulsator to thereby help the settlement of the laundry article; and (c) repeating the steps (a) and (b) at least N number of times. The method further comprises, between the steps (B) and (C), a step of: (E) stopping the driving of the motor before the switching from the forward direction to the backward direction and vice versa for a predetermined period to expose the spread laundry article to the heated air.

BRIEF DESCRIPTION OF THE DRAWINGS

The above and other objects and features of the present invention will become apparent from the following description of preferred embodiments taken in conjunction with the accompanying drawings, in which.

DETAILED DESCRIPTION OF THE PREFERRED EMBODIMENTS

Figure 1:
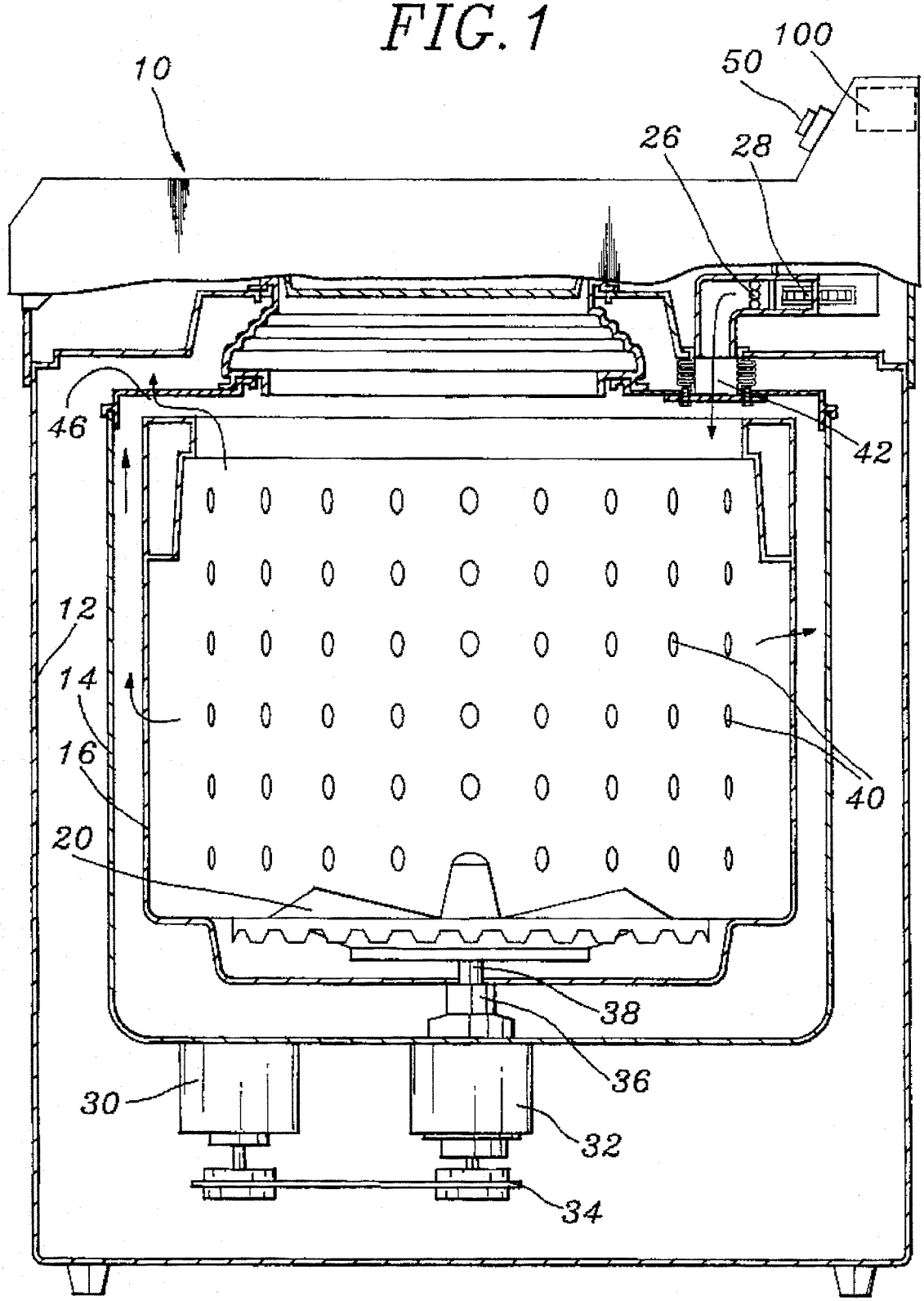
FIG. 1 shows a schematic sectional view of the overall structure of a vortex-type washing machine equipped with a laundry dryer in accordance with the present invention.

Referring now to FIG. 1, there is shown a washing machine equipped with a laundry dryer in accordance with the present invention. The washing machine 10 comprises a housing 12 and a stationary washer tub 14 fixedly mounted within the housing 12 for containing therein a level of washing fluid or detergent solution. Connected to the bottom of the stationary washer tub 14 are an electrical motor 30 and a clutch assembly 32 coupled to the electrical motor 30 by a belt-pulley assembly 34. As shown, the electrical motor 30 and the clutch assembly 32 are both secured to the stationary washer tub 14 by means of suitable fastener means, e.g., welding or threading. The electrical motor 30 is capable of rotating depending upon the drying process, in a clockwise or counterclockwise direction, and, the clutch assembly 32 serves to selectively couple the driving force generated by the electrical motor 30 with one of a first and a second driven shafts 36 and 38.

The first driven shaft 36 carries at its top end a rotatable washer tub 16 which is kept immovable during the washing process but is caused to rotate at a high speed during the dewatering process. The rotatable tub 16 is provided with, at its side wall, a plurality of washing fluid communication holes 40 permitting the washing fluid to flow into or out of the rotatable tub 16.

Rotatably mounted on the bottom surface of the rotatable tub 16 is a pulsator 20 carried by the second driven shaft 38. The pulsator 20 is rotatable in a forward or backward direction to create a vortex flow within the rotatable tub 16.

In a top portion of the housing 12, there is provided a heater 26 for heating ambient air and a fan 28 for blowing the heated air into the rotatable tub 16 under the control of a control device 100. The air blown by the fan 28 is entered into the rotatable tub 16 through an inlet 42 to circulate therein. After the completion of the circulation, a portion of the air is directly discharged via the top of the rotatable tub 16 through an outlet 46, and another portion of the air is discharged via the holes 40 and the passage between the top of the rotatable tub 16 and the lid of the stationary tub 14 through the outlet 46.

Figure 2:
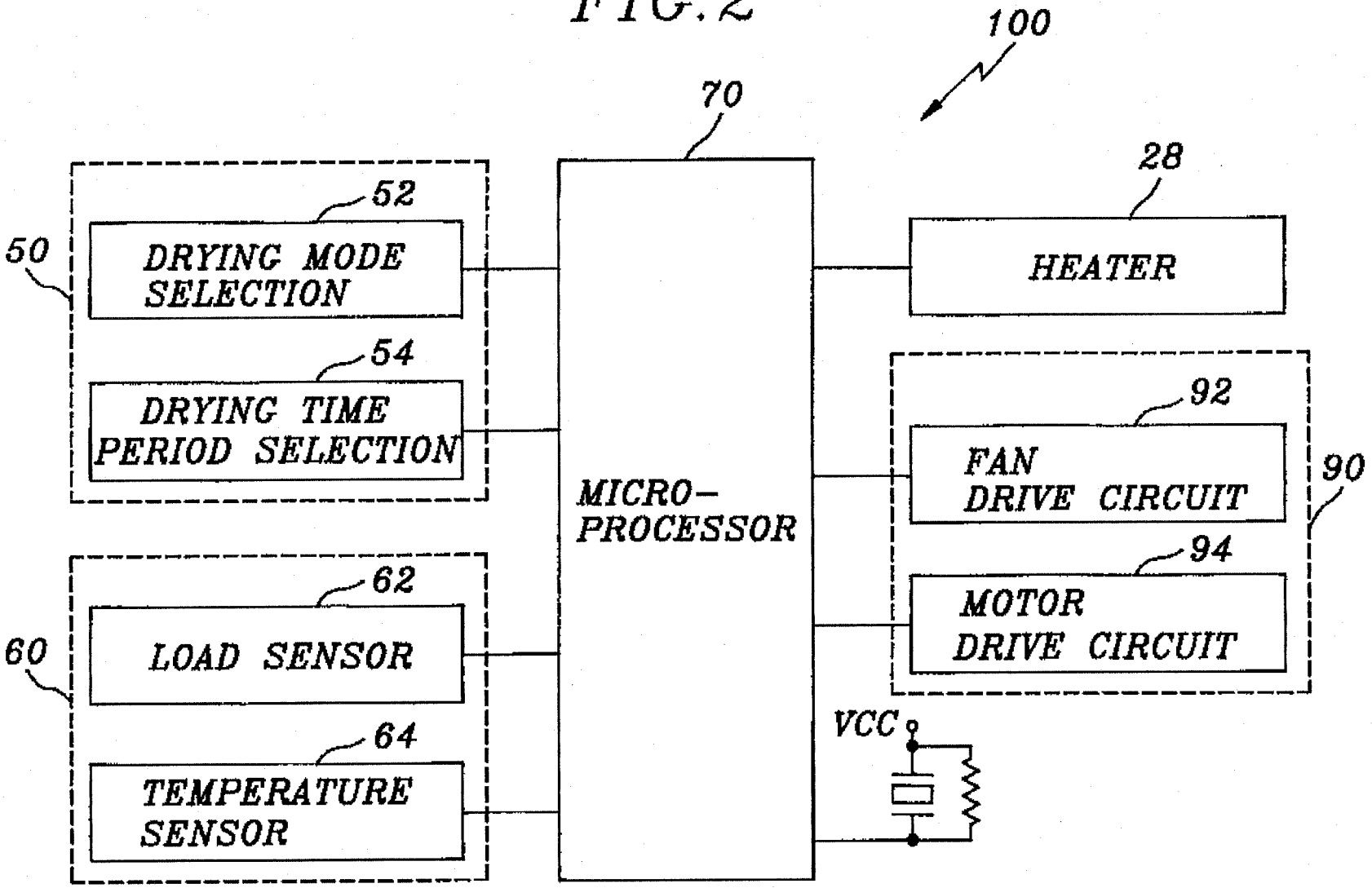
FIG. 2 illustrates a schematic block diagram of a control device in accordance with the present invention.

FIG. 2 shows a schematic diagram of the control device 100 for controlling the drying process of the washing machine 10. The control device 100 comprises a switch pad 50, a detection block 60, a microprocessor 70, and a load drive circuit 90. As shown in FIG. 2, the switch pad 50 and the detection block 60 are connected to the inputs of the microprocessor 70, and the load drive circuit 90 is connected to the outputs of the microprocessor 70.

The switch pad 50 includes a drying mode selection switch 52 and a drying time period selection switch 54 for manually selecting a drying time period. When the drying mode is selected by the drying mode selection switch 52 and the drying time period is set through the use of the drying time period selection switch 54, a drying mode selection signal indicative of the drying process for the laundry articles to dry is issued to the microprocessor 70. The microprocessor 70, in response to the drying mode selection signal, executes the drying process for the drying time period manually selected by the drying time period selection switch 54 or a predetermined drying time period which will be discussed hereinafter.

The detection block 60 includes a load sensor 62 for detecting the weight of the laundry articles in the rotatable tub 16 and a temperature sensor 64 for detecting the temperature in the rotatable tub 16. The load sensor 62 and the temperature sensor 64, as well known in the art, after detecting the weight and the temperature, issue a load signal indicative of the weight of laundry articles and a temperature signal indicative of the temperature to the microprocessor 70, respectively.

The microprocessor 70 may be of any type suitable for such control purpose, which has a storage region therein or a separate memory device. The storage region may contain a plurality of drying control programs stored in the form of instructions and data. Each drying control program may be selected with the load signal from the load sensor 62. The microprocessor 70 may execute and process a series of instructions and data in response to the load signal to provide control signals to the load drive circuit 90.

The load driving circuit 90 has a fan driving circuit 92 and a motor driving circuit 94. The fan driving circuit 92 is responsive to a fan control signal from the microprocessor 70 to enable the fan 28, shown in FIG. 1, to blow the heated air produced by the heater 26. The motor driving circuit 94 is responsive to a motor control signal from the microprocessor 70 to energize the motor 30 for the control of the pulsator 20. The motor control signal includes forward and reverse driving signals, which are repeatedly sent to the motor drive circuit 92 during the drying process. Accordingly, the motor 30 is alternately rotated in the forward and backward directions to cause forward and backward rotations of the pulsator 20.

In accordance with a preferred embodiment of the invention, in the course of each of the forward and reverse direction rotations, the motor 30 is repeatedly subjected to the ON/OFF control to cause the pulsator 20 to periodically rotate and pause in each direction.

The periodic repetition of the rotation and the pause states of the pulsator 20 is performed for N number of times whenever the rotation direction is reversely changed where N is a positive integer (N=1, 2, 3, . . . ). The number N is preferably from 2 to 4, as will be illustrated below.

The periodic repetition of rotation and pause of the pulsator 20 helps to untie or set loose the laundry items which may have been entangled during the dewatering process. It has been found that the laundry articles can be effectively untangled by rotating the pulsator 20 at an angle of not more than 180°, most preferably approximately 90°, from the pause state. The rotation of the pulsator 20 at the angle of 90° is achieved by turning the motor on for a time period "$T_1$" of about 0.2 to 0.4 second.

The periodic pause state between rotations of the pulsator 20 is employed to settle down the laundry articles which have been agitated during the rotation of the pulsator 20; and may continue for a time period "$T_2$" ranging from about 0.3 to 1 second, preferably, 0.6 second.

Further, the motor 30 may preferably be controlled to a stop to have the pulsator 20 in an idle state for a predetermined time period "$T_3$" after the completion of the periodic repetition for the N number of times before turning from the forward direction to the backward direction and vice versa. The time period for the pause state permits the heated air to sufficiently concentrate on the exposed portion of the laundry load to thereby improve the drying efficiency. The stop state of the motor 30 can be made to continue in time intervals of, e.g., about 20 to 30 seconds, preferably, 20 seconds.

Figure 3:
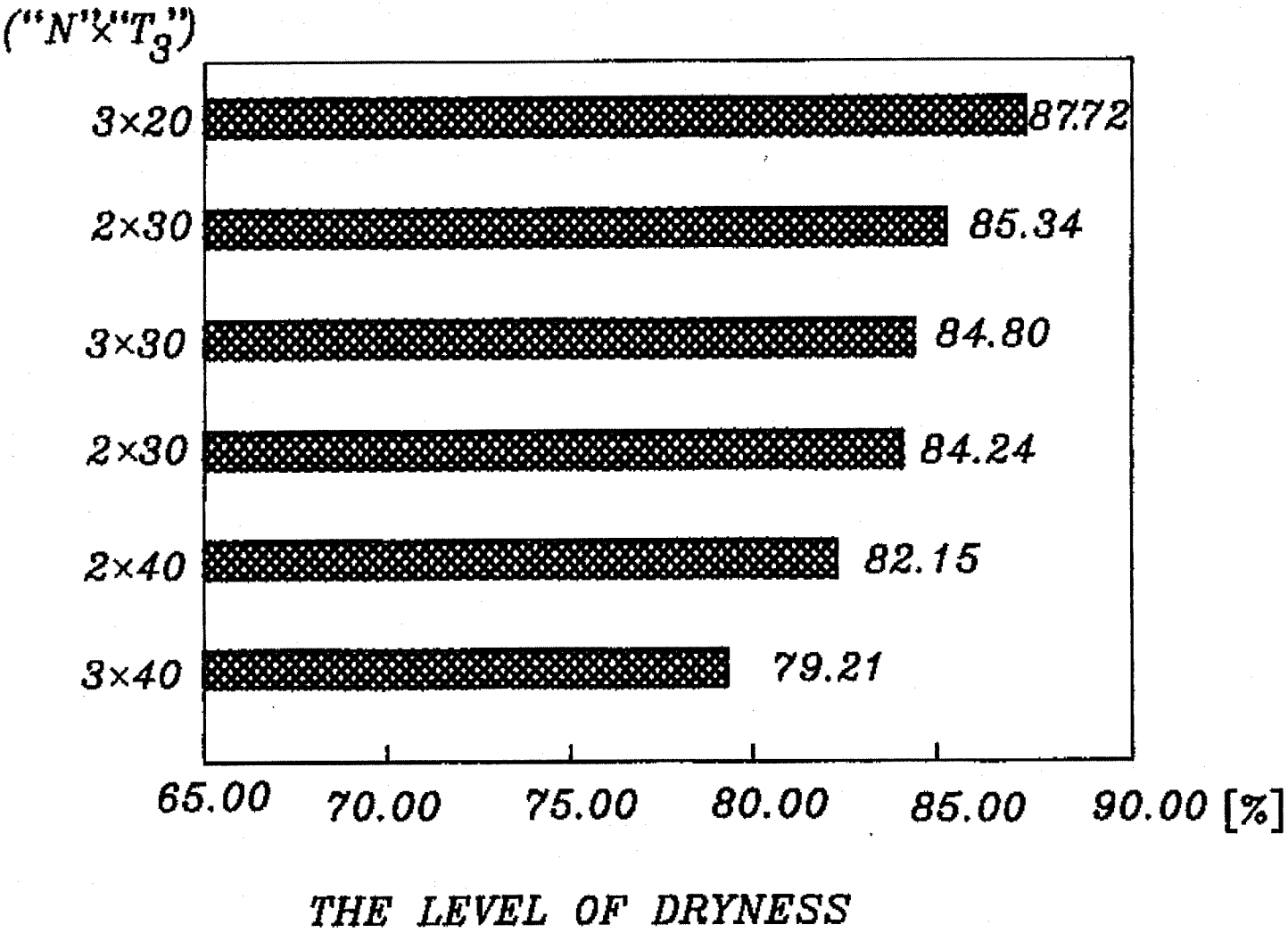
FIG. 3 is a graph describing the relationship between the degree of drying and the drying efficiency.

FIG. 3 is a graph showing the data for the different levels of dryness obtained by applying various conditions, which are empirically obtained by way of conducting the drying process with the N values of 2 and 3 and the intervals of 20 to 40 seconds. In this connection, it is assumed that the motor is rotated at the angle of 90° as set forth above.

As can be seen from the graph, the data exhibits a higher level of dryness when the number N is 3 and the time period is 20 seconds. In addition, although it is not shown herein, essentially same results are obtained even if the number N is 4, 5, or higher.

Figure 4A:
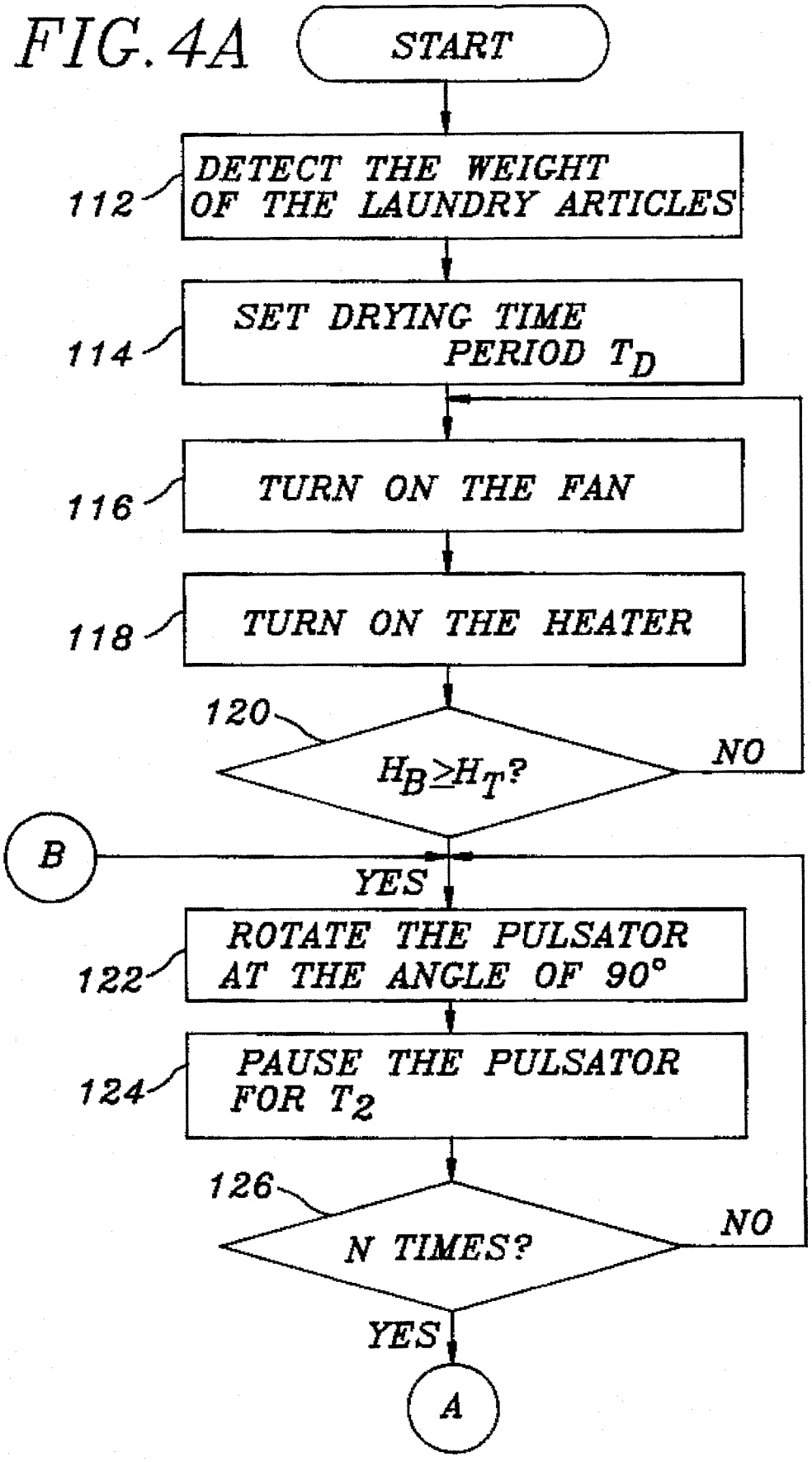
FIGS. 4A and 4B are flow charts explaining the control sequence executed by the control device shown in FIG. 2.
Figure 4B:
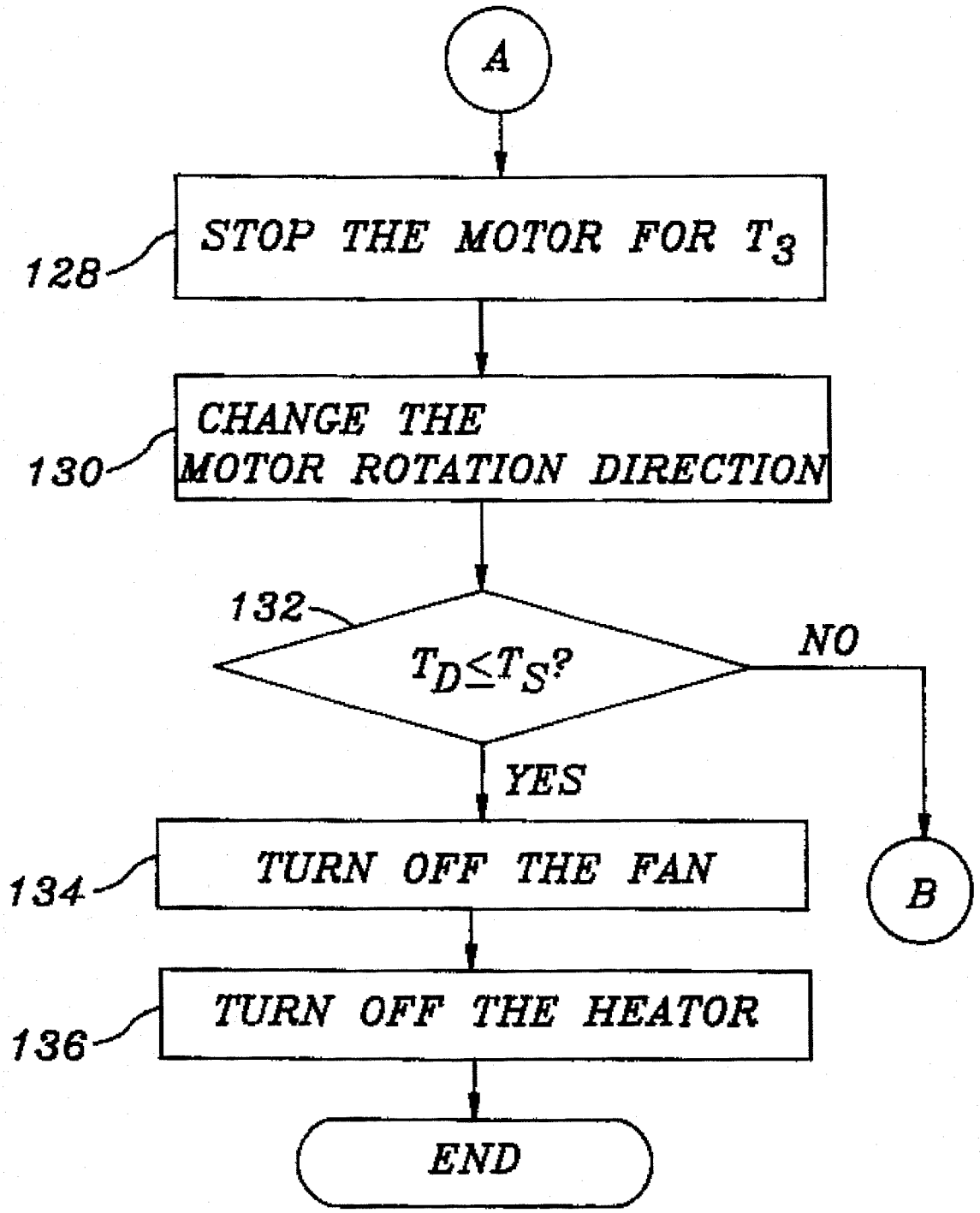

Referring now to FIGS. 4A and 4B, there is illustrated a flow diagram explaining the operation of the drying process, wherein the control operation begins at block 112 where the weight of the laundry articles is detected by the load sensor 62 when the drying mode selection switch 52 is depressed by the user. The detected weight by the load sensor 62 is signaled to the microprocessor 70.

In step 114, the microprocessor 70 automatically sets a drying time period "$T_D$" with the detected weight as listed in Table 1.

TABLE 1

| Weight of dried laundry articles(kg) | Weight of dewatered laundry articles(kg) | Time period(min.) |
|---|---|---|
| 1 | 1.82 | 60 |
| 2 | 3.7 | 120 |
| 3 | 5.45 | 180 |
| 4 | 7.27 | 240 |

The time period for drying may be also set as the one selected by the drying time period selection switch 54.

In steps 116 and 118, the heater 26 and the fan 28 are driven under the control of the microprocessor 70 to heat ambient air and blow the heated air into the rotatable tub 16 through the inlet 42. And then the control process proceeds to step 120 where it is determined whether the temperature "$H_B$" in the rotatable tub 16 reaches a predetermined temperature "$H_T$" necessary to dry the laundry articles, e.g., a temperature of 30° C. If the temperature $H_B$ reaches the predetermined temperature $H_T$, the control process flows to steps 122 and 124 where the pulsator 20 is rotated at an angle of 90° for the first predetermined time period "$T_1$" and then paused for the second predetermined time period "$T_2$".

As in step 126, the repetitive rotation and pause states of the pulsator 20 are be repeated for the N number of times, e.g., 3. Thereafter, the control process goes to step 128 to make the pulsator 20 the idle state for the third predetermined time period "$T_3$".

After the lapse of the third time period $T_3$, the rotation direction of the motor 30 is changed to the reverse direction in step 130 and the control process advances to step 132.

In step 132, it is checked whether the time period "$T_S$" spent to dry the laundry articles reaches the predetermined drying time period $T_D$ as set forth in step 114. If the test result is NO, the control process returns to step 122 and the operation as mentioned above is continued therefrom until the time period $T_S$ lapses the predetermined time period $T_D$. If, however, the test result is YES, the control process goes to step 134 and then step 136 where each of the heater 26 and the fan 28 is turned off to finish the drying process.

While the present invention has been shown and described with respect to the preferred embodiments, it will be apparent to those skilled in the art that many changes and modifications may be made without departing from the spirit and scope of the invention as defined in the appended claims.

What is claimed is:

1. A method for controlling the drying process in a vortex-type washing machine having a rotational tub accommodating a laundry article for drying therein, a heating means, a pulsator rotatably mounted on the bottom surface of the tub, a motor for rotating the pulsator, said method comprising the steps of:

(A) providing heated air to the tub by using the heating means;

(B) driving the motor in a forward direction;

(C) driving the motor in a reverse direction; and (D) repeating the steps (B) to (C) until the laundry article becomes dried to a desired level, wherein each of the steps (B) and (C) includes the steps of:

(a) turning on the motor to rotate the pulsator to spread the laundry article in the rotational tub, wherein the pulsator is rotated by the motor at an angle of not more than 180°;

(b) turning off the motor to pause the rotation of the pulsator to thereby help the settlement of the laundry article, wherein the pause state of the pulsator is carried out for a time period of not more than 1 second; and (c) repeating the steps (a) to (b) at least N number of times wherein said N number is a positive integer.

2. The method of claim 1, wherein said N is 2 or 3.

3. The method of claim 1, wherein the method further comprises, between the steps (B) and (C), a step of:

(E) stopping the driving of the motor to cause the pulsator to stay in an idle state before switching from the forward direction to the reverse direction and vice versa for a predetermined time period to expose the spread laundry article to the heated air.

4. The method of claim 3, wherein, in the step (a), the pulsator is rotated by the motor at an angle of about 90°.

5. The method of claim 3, wherein, in the step (b), the pause state of the pulsator is carried out for a time period of about 0.6 second.

6. The method of claim 5, wherein, in the step (E), the idle state of the pulsator is continued for a time period ranging from 20 to 30 seconds.

7. The method of claim 5, wherein, in the step (E), the idle state of the pulsator is continued for a time period of 20 seconds.

8. The method of claim 1, wherein the method further comprises, before the step (A), a step of (F): setting a predetermined drying time period for drying the laundry article to the desired level.

* * * * *